US008191558B2

(12) United States Patent
Gueret

(10) Patent No.: US 8,191,558 B2
(45) Date of Patent: Jun. 5, 2012

(54) APPLICATOR FOR APPLYING A COMPOSITION TO KERATINOUS MATERIALS AND INCLUDING A SOURCE OF VIBRATION

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 794 days.

(21) Appl. No.: 12/183,620

(22) Filed: Jul. 31, 2008

(65) Prior Publication Data

US 2009/0032046 A1 Feb. 5, 2009

Related U.S. Application Data

(60) Provisional application No. 60/954,598, filed on Aug. 8, 2007.

(30) Foreign Application Priority Data

Jul. 31, 2007 (FR) ..... 07 56837

(51) Int. Cl.
*A45D 40/26* (2006.01)

(52) U.S. Cl. ..... 132/218; 15/143.1; 401/129

(58) Field of Classification Search ..... 132/218, 132/216, 318, 320; 15/22.1, 143.1; 401/126, 401/129

See application file for complete search history.

(56) References Cited

U.S. PATENT DOCUMENTS

| | | | | |
|---|---|---|---|---|
| 3,030,967 | A | 4/1962 | Peyron | |
| 6,059,473 | A * | 5/2000 | Gueret | 401/129 |
| 6,227,737 | B1 * | 5/2001 | Lightfoot | 401/129 |
| 6,341,912 | B1 | 1/2002 | Gueret | |
| 2005/0008420 | A1 | 1/2005 | Gueret | |
| 2005/0031401 | A1 * | 2/2005 | Gueret | 401/129 |
| 2006/0032512 | A1 * | 2/2006 | Kress et al. | 132/218 |

FOREIGN PATENT DOCUMENTS

| | | | |
|---|---|---|---|
| DE | 41 40 166 | A1 | 1/1993 |
| EP | 0 232 819 | A2 | 8/1987 |
| EP | 1 477 083 | A1 | 11/2004 |
| FR | 2 882 506 | A1 | 9/2006 |
| WO | WO 99/52488 | | 10/1999 |
| WO | WO 2006/050577 | A1 | 5/2006 |
| WO | WO 2006/090343 | A1 | 8/2006 |
| WO | WO 2006/130644 | A2 | 12/2006 |

* cited by examiner

*Primary Examiner* — Todd Manahan
*Assistant Examiner* — Brianne Kalach
(74) *Attorney, Agent, or Firm* — Oliff & Berridge, PLC

(57) ABSTRACT

The present invention relates to an applicator for applying a cosmetic composition to human keratinous materials or for adding finishing touches to makeup, the applicator comprising: a vibration source including a vibration generator that vibrates at a frequency lying in the range 1 Hz to 500 Hz, a handle, a stem carried by the handle and an applicator or finishing member for coming into contact with keratinous materials.

21 Claims, 8 Drawing Sheets

APPLICATOR FOR APPLYING A COMPOSITION TO KERATINOUS MATERIALS AND INCLUDING A SOURCE OF VIBRATION

This non provisional application claims the benefit of French Application No. 07 56837 filed on Jul. 31, 2007 and U.S. Provisional Application No. 60/954,598 filed on Aug. 8, 2007.

The present invention relates to an applicator for applying a composition to keratinous materials, for example on skin, lips, nails or eyelashes, or for adding finishing touches to makeup, the applicator including an applicator or finishing member that receives vibration from a vibration source, during or after application.

BACKGROUND

French patent FR 2 882 506 and application WO 2006/090343 disclose cosmetic-treatment methods using applicators that vibrate.

Applications WO 2006/050577 and WO 2006/130644 disclose mascara applicators that vibrate.

Some known devices use a vibration source comprising a vibration generator constituted by a motor that drives an off-center fly-weight in rotation.

The amplitude and the frequency of vibration produced by such a vibration generator depend on the speed of rotation of the motor.

The speed is imposed by the power supply voltage and cannot be modified easily, except by making the power supply circuit of the motor more complex. However, it can turn out to be desirable to adjust, especially during the manufacturing of the applicator, in some other way, the amplitude and/or the direction of vibration for use in various applicator or finishing members, while nevertheless using the same vibration generator, so as to achieve an economy of scale on said vibration generator. In addition, it can turn out to be useful to filter vibration, so as to reduce the amplitude of vibration that has an unwanted frequency, e.g. a harmonic frequency.

SUMMARY

Amongst other things, the invention seeks to improve still further applicators that vibrate. More generally, the invention proposes acting on the vibration delivered to the applicator or finishing member so as to adapt it in the best possible way to applying makeup to, or to treating, human keratinous materials.

In one of its aspects, the invention thus provides an applicator for applying a cosmetic composition to human keratinous materials or for adding finishing touches to makeup, the applicator comprising:

- a vibration source including a vibration generator that vibrates preferably at a frequency lying in the range 1 hertz (Hz) to 500 Hz, better in the range 10 Hz to 300 Hz, e.g. in the range 50 Hz to 200 Hz, the generated vibration being sinusoidal, for example; and
- an applicator or finishing member for coming into contact with keratinous materials;

the applicator further comprising at least one of the following:

- a first portion via which vibration travels along a shortest path between the vibration generator and the applicator or finishing member, the first portion being for example flexible, in contact with at least one second portion for vibration inlet or outlet, for example less flexible than the first portion, for example that is made out of a material that is harder than the material of the first portion; and
- a portion, which may be the above-mentioned first portion, including a succession of recesses and/or at least one hollow portion that is not of solid circular section, or an undulating or helical portion, on the shortest path for vibration from the vibration generator to the applicator or finishing member.

In an exemplary embodiment the above-mentioned first portion is made out of a material that is not as hard as the second portion, for example out of an elastically-deformable material, e.g. out of elastomer, conveys vibration differently and can in particular damp vibration, or, on the contrary, amplify vibration, depending on its shape, and the direction and the frequency of the vibration, for example.

With the first portion, the invention thus provides relatively simple means for acting on vibration so as to adapt it to the cosmetic treatment to be performed and/or so as to improve the effect of the vibration.

The succession of recesses, e.g. a succession of annular grooves, the hollow portion, or the above-mentioned undulating or helical portion, can also be used to modify the delivery section available to the vibration reaching the applicator or finishing member, and to act on the vibration, e.g. so as to facilitate the transmission of vibration that has a certain orientation and/or frequency.

The vibration generator may belong to a handle of the applicator which may be the closure cap for the receptacle containing the composition to apply.

By way of example, the above-mentioned first portion may be situated between second and third portions made out of materials that are harder than the first portion.

At least one of the second and third portions may be fitted on the first portion. At least one of the second and third portions may be molded in contact with the first portion.

The second portion may also be held in contact with the first by clamping.

The first portion may be flexible. The term "flexible" should be understood to mean that the user can easily deform the first portion with one finger, and bend it for example with an angle of at least 5°, or even 10°, 15°, 20° or more in some exemplary embodiments, in a reversible way, the first portion being able to regain its first configuration by elasticity.

The first portion may be made out of a material selected, for example, from: elastomers; thermoplastics; thermoplastic elastomers; low-density polyethylene (LDPE); polyvinyl chloride (PVC); Hytrel®; ethylene-propylene-diene terpolymer (EPDM); ethyl vinyl acetate (EVA); styrene-isoprene-styrene (SIS); styrene-ethylene-butylene-styrene (SEBS); latexes; silicone rubbers; nitrile rubbers; butyl rubbers; polyurethanes; polyether block amide; amongst others.

At least one of the second and third portions may, for example, be made out of a material selected from: polyolefins; polypropylene (PP); polyoxymethylene (POM); polyamides; polystyrenes; acetal; amongst others.

The applicator or finishing member may be fitted or molded on the first portion. The first portion may include a housing for receiving a fastener endpiece for fastening the applicator or finishing member on the first portion.

The applicator may comprise a stem and the first portion may belong to the stem.

The stem may be deprived of any metal part, especially any metal spring.

The stem may be of non hollowed cross section on a part representing at least the quarter, the third or half of its length, for example more than half the apparent length extending below the closure cap.

The stem may be made interdependent of the closure cap for the receptacle containing the composition to apply in various manners.

The stem may be molded with the closure cap or part of the cap. The stem may also be fitted on the cap.

The stem may not include the vibration source.

The stem may be situated entirely under the vibrating source.

The first above mentioned portion may be in the lower part of the stem, in contact with or near the applicator or finishing member, for example by supporting the core of the applicator or finishing member when this one is a brush with a twisted core or by supporting a mounting end when the applicator or finishing is a comb. For example, the first portion may be in the lower half, even the lower third or the lower fourth of the stem. The first portion may be in the lower half of the apparent portion of the stem, when the applicator is looked at in elevation view, i.e. in the portion of the stem which extends in an apparent way under the closure cap to the bottom, in direction of the applicator or finishing member, when the longitudinal axis of the applicator is vertical and the closure cap on top. The proximity of the first portion with the applicator or finishing member may avoid a too great amplitude of vibration of the applicator or finishing member and allow a better control at the time of the make-up.

In exemplary embodiments of the invention, the applicator comprises:

the handle the stem carried by on the handle the applicator or finishing member at the end of the stem for coming into contact with keratinous materials; and the stem further comprises a flexible first portion via which vibration travels along a shortest path between the vibration generator and the applicator or finishing member, the first portion being in contact with at least one second portion for vibration inlet or outlet, the first portion being nearer to the applicator or finishing member than to the vibration generator.

The expression "first portion being nearer to the applicator or finishing member than to the vibration generator" should be understood to mean that the distance between the first portion and the applicator or finishing member is lower than that between the first portion and the vibration generator.

For example, the first portion defines the distal end of the stem and a non zero distance separates the proximal end of the first portion from the vibration generator, which for example is incorporated in the closure cap. The distance to the vibration generator for example is measured starting from the lower end of a motor driving in rotation an unbalanced mass.

When the first portion is separated from the applicator or finishing member, by a first distance, measured along the longitudinal axis of the applicator, between the proximal end of the applicator or finishing member and the distal end of the first portion, and the first portion is separated by a second distance from the vibration generator measured between the distal end of the first portion and the proximal end of the vibration generator, the second distance is greater than the first.

In exemplary embodiments of the invention, the first portion may include at least an annular groove, a recess opening out onto its lateral surface, and/or a through opening, in particular of closed outline. The through opening may be of axis that is perpendicular to the longitudinal axis of the stem.

The applicator may also include a through opening of closed outline on the shortest path for vibration, at a position not in the above-mentioned first portion.

The through opening, whether it be formed on the first portion or not, may comprise at least one slot.

The applicator or finishing member may extend along a longitudinal axis that optionally coincides with the longitudinal axis of a proximal portion of a support to which the applicator or finishing member is connected, for example the above-mentioned stem.

The first portion, or the above-mentioned hollow portion may present a shape that is not axially symmetrical, e.g. so as to create asymmetry in the way vibration is treated by the first portion or by the hollow portion.

The applicator or finishing member may be a brush or a comb for applying a composition to the eyelashes and/or the eyebrows, or for adding finishing touches to makeup on the eyelashes and/or the eyebrows. The applicator or finishing member may be an off-centered brush including at least one portion in which the core is off-center relative to the axis of the envelope surface of the brush, defined by the free ends of the bristles.

The applicator or finishing member may be in the form of a paint brush or it may comprise foam or a membrane. The applicator or finishing member may be flocked.

In another of its aspects, the invention also provides a device in which the first portion help fixing a vibration generator on the applicator or on a vibration source mounted on the applicator.

In another of its aspects, the invention also provides a method of applying a cosmetic composition to human keratinous materials or for adding finishing touches to makeup, the method comprising:

bringing a surface of an applicator or finishing member that is being subjected to vibration coming from a vibration generator into contact with keratinous materials, the vibration essentially being of frequency lying in the range 1 Hz to 500 Hz for example, better in the range 10 Hz to 300 Hz; and modifying the vibration in intensity and/or in orientation by disposing on the shortest path for vibration between the vibration source and said surface, at least one of the following:

a first portion disposed in contact with a second portion for vibration inlet or outlet, such as defined above, for example hardness that is greater than the hardness of the first portion; and a succession of recesses and/or a hollow portion that is not of solid circular section, or an undulating or helical portion. By way of example, the hollow portion could have a through opening of closed outline.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

Figure 1:
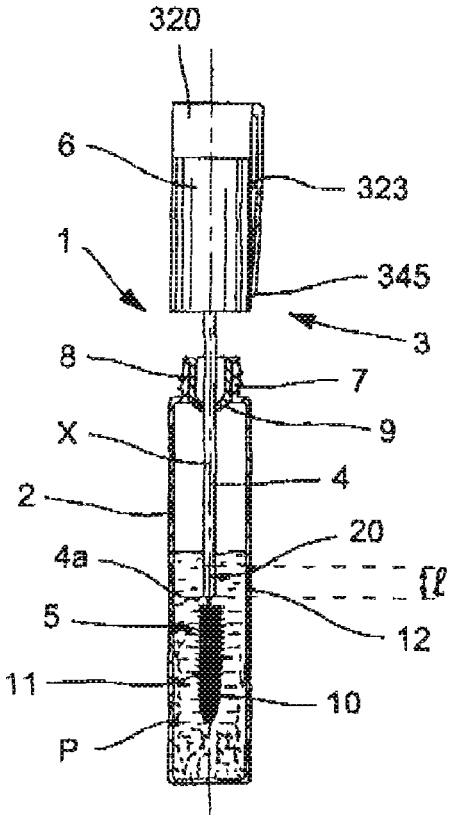
FIG. 1 is an elevation view, partially in longitudinal section, showing an embodiment of a packaging and applicator device made in accordance with the invention.

FIGS. 1 to 5 show a packaging and applicator device 1 comprising: a receptacle 2 containing a composition P for application to the eyelashes or the eyebrows, e.g. mascara; and an applicator 3 comprising a stem 4 that is provided at its distal end 4*a* with an applicator member 5 and that is connected at its proximal end to a handle 6 that also constitutes a closure cap for closing the receptacle 2. The receptacle is fitted with a wiper member 7, e.g. constituted by a part that is made of elastomer and that is inserted into the neck 8 of the receptacle. The wiper member 7 can optionally be conventional, and it can be adjustable.

The handle 6 is arranged so as to close the receptacle 2 in leaktight manner, when said handle is fully screwed onto the neck 8 in manner known per se.

In the embodiment shown, the wiper member 7 defines a wiper orifice 9 of section that is circular, having a diameter that corresponds substantially to the diameter of the stem 4, said stem being of cross-section that is circular over at least all of its portion that is engaged in the receptacle.

In the embodiment under consideration, the stem 4 presents a longitudinal axis X that is rectilinear and that coincides substantially with the axis of the neck 8 of the receptacle 2 when the applicator 3 is in place on said receptacle.

The stem 4 comprises: a first portion 20 that is flexible and that, in the embodiment in FIGS. 1 to 5, extends from the distal end 4*a* of the stem 4 over a distance l; and a second portion 25 that is more rigid. The length l of the first portion 20 lies in the range 10 mm to 20 mm, or even more.

In the embodiment shown in FIGS. 1 to 5, the flexible portion 20 is of cross-section that is circular, for example of diameter that is equal to the diameter of the second portion 25, but it could be of a different diameter.

The flexible portion 20 is made for example out of a material that is more flexible than the material from which the second portion 25 is made, e.g. a material from the following list: an elastomer; a thermoplastic; a thermoplastic elastomer; LDPE; PVC; Hytrel®; EPDM; EVA; SIS; SEBS; latex; silicone rubber; nitrile rubber; butyl rubber; polyurethane; polyether block amide; this list not being limiting.

By way of example, the second portion 25 is made out of plastic material, for example a polyolefin or out of POM.

Figure 2:
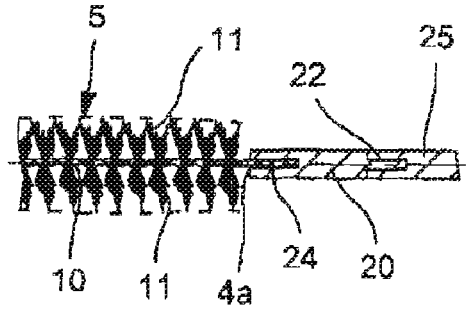
FIG. 2 shows a detail of FIG. 1.

In the embodiment under consideration, the applicator member 5 is a brush including a core 10 that is formed by two twisted metal strands, the core 10 having a proximal portion that is fastened in a housing 24 of the stem 4, e.g. being force-fitted in the housing 24, as shown in FIG. 2. The housing 24 is formed in the first portion 20 in the embodiment in FIGS. 1 to 5.

The core 10 carries bristles 11 that are held by clamping between the turns of the core 10 and that extend substantially radially from the core.

The applicator member 5 could be in some other form, e.g. a comb, an injection-molded brush, a molded and/or flocked endpiece, a paint brush, amongst others.

The handle 6 defines a housing 15 that is open on the side remote from the stem 4 so as to receive a vibration source 320. More particularly, the handle can include: a transverse wall 16 on which the stem 4 is connected, and that defines the bottom of the housing 15; and a tubular wall 18 that surrounds the housing 15. A window 19 can be formed in the wall 18 so as to receive a contactor 323 of the vibration source 320, and so as to enable said contactor to be actuated by the user while the vibration source 320 is in place in the handle 6.

Figure 3:
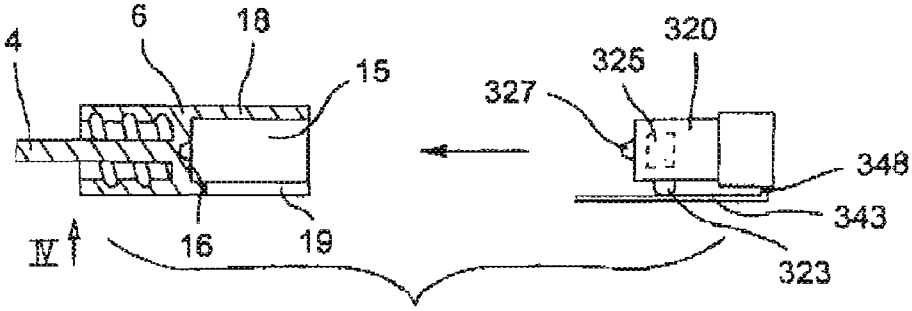
FIG. 3 shows the vibration source being mounted on the body of the applicator.
Figure 4:
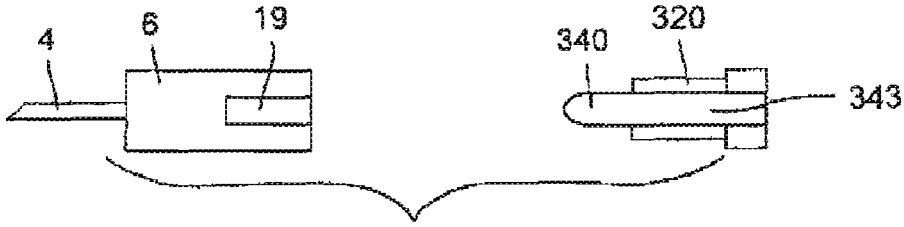
FIG. 4 is a view as seen looking along arrow IV in FIG. 3.

In the example of FIGS. 1 to 3, one considers that the overall length of the stem is its length measured between its proximal end of connection to wall 16 and its distal end.

The first portion 20 is in the lower half of the stem.

The first portion 20 is also in the lower half of the stem as it shows on FIG. 1, i.e. the portion of the stem extending under the handle 6.

The contactor 323 is advantageously a transient contact, i.e. it changes state as the user actuates it, and returns to its initial state when the user releases it. The contactor 323 could also be a permanent contact.

The vibration source 320 comprises: an electricity source, e.g. at least one optionally-rechargeable battery, not shown in the figures; and a vibration generator 325 that is a motor driving an off-center fly-weight, for example, the motor preferably being a disk-shaped motor. By way of example, the vibration source includes a 1.5 volt (V) battery. By way of example, the motor is arranged so as to turn at a speed of rotation lying in the range 5000 revolutions per minute (rpm) to 12000 rpm when powered by the 1.5 V battery. The motor can be contained with the off-center fly-weight in a disk-shaped casing.

Depending on the orientation of the axis of rotation of the motor, vibration can be generated either transversally to the longitudinal axis X of the device 1, or parallel to the longitudinal axis, or even in some other way. Where appropriate, the applicator can be arranged so as to enable the user to vary the orientation of vibration relative to the applicator member 5.

The vibration source 320 can include a portion 327 that comes into engagement with the handle 6 so as to transmit vibration from the vibration source to the applicator member 5 via the stem 4.

In the embodiment under consideration, the second portion 25 of the stem 4 is molded integrally with the handle 6, but it is not beyond the ambit of the present invention for the stem 4 to be fitted on the handle, or for said handle to be made by assembling together at least two parts, one of which carries the stem 4.

By way of example, the fundamental frequency of vibration generated by the motor lies in the range 1 Hz to 500 Hz, e.g. in the range 10 Hz to 300 Hz, or in the range 50 Hz to 200 Hz.

Figure 5:
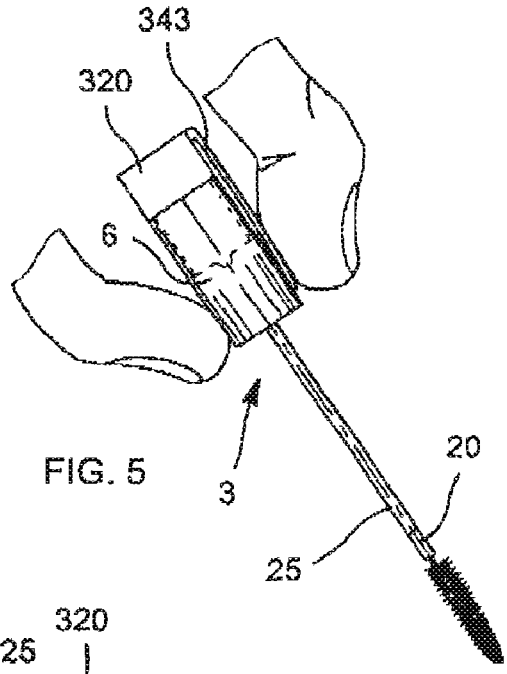
FIG. 5 shows the FIG. 1 applicator in use.

The applicator 3 includes a control surface 340 on which the user can press, as shown in FIG. 5, so as to trigger the operation of the vibration source 320.

In the example under consideration, the control surface 340 is defined by a control lever 343 that is connected to the vibration source 320, e.g. being molded integrally with a portion of the housing of said vibration source. In a variant, the control surface 340 could be defined by the contactor 323 itself.

In the embodiment under consideration, the control lever 343 extends beyond the portion 327, and has its end 345 that comes into the proximity of the end of the handle, as can be seen in FIG. 1.

The lever 343 can flex about the connection zone 348 for connecting with the housing of the vibration source 320 in such a manner as to enable the user, by pressing on the control surface 340, to act on the contactor 323.

It can be seen in FIG. 5 that the control surface 340 is situated between the vibration source 320 and the applicator member 5, relative to the longitudinal axis X of the applicator, thereby enabling the user to manipulate the applicator member 5 with precision, given the distance between the fingers and the applicator member 5, without however being exposed to significant vibration from the vibration generator 325, since said vibration generator is situated set back from the grip zone for gripping the applicator 3.

The first portion 20 exerts influence on vibration that is transmitted to the applicator member 5, in terms of amplitude and/or orientation. The first portion can act as a frequency filter.

By way of example, the first portion 20 can have a length that is selected in such a manner as to amplify vibration that is transmitted to the applicator member 5, and enable the applicator member 5 to have greater vibration amplitude, for example.

In particular, the first portion 20 can be made in such a manner as to enable the applicator member to resonate at the vibration frequencies of the vibration generator, thereby making it possible to amplify the amplitude of said vibration.

The first portion 20 can be fastened on the second portion 25 in various ways, including an endpiece 20*f* that is force-fitted in a housing 22 of the second portion 25, for example, as shown in FIG. 2.

FIG. 2 shows that the housings 22 and 24 can have the same size and the same shape, thereby making it possible to eliminate the flexible portion 20 and insert the core 10 in the housing 22 when the flexible portion 20 is not required.

FIG. 2 also shows that the second portion 25 is of full cross section apart from the housing 22.

Figure 6:
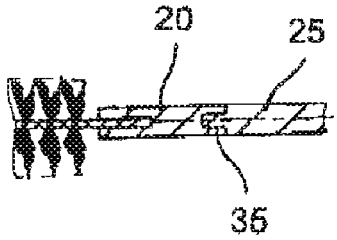
FIGS. 6 to 28 show variant embodiments of the above-mentioned first portion.

By way of example, the first portion 20 can include a housing 35 for receiving a male fastener portion of the second portion 25, as shown in FIG. 6.

Figure 7:
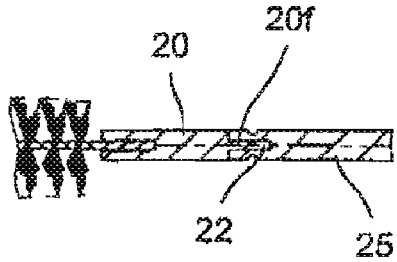

The first portion 20 can also be overmolded onto the second portion or vice versa, or it may be held by crimping in the housing 22 of the stem 4, as shown in FIG. 7.

Figure 8:
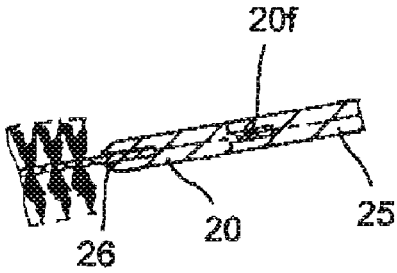

In addition, the shape of the first portion 20 can be other than cylindrical, as shown in FIG. 8.

By way of example, the first portion 20 can include a beveled end 26, as shown in FIG. 8, that can make it easier to put the applicator 3 back into the receptacle 2.

Figure 9:
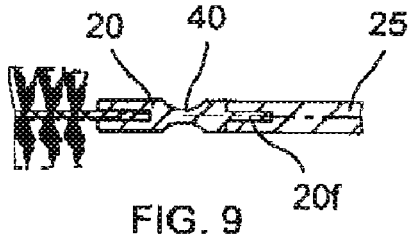
Figure 10:
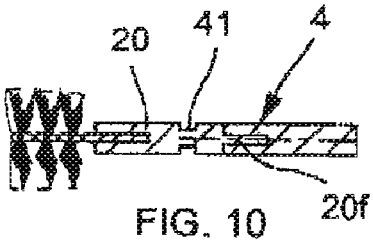

The first portion 20 can also include a thin portion 40, e.g. it can be hour-glass shaped, as shown in FIG. 9, or with a square-sided annular groove 41, as shown in FIG. 10.

Figure 12:
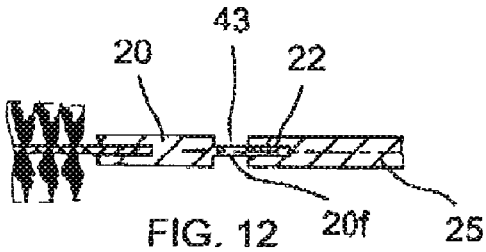

It is also possible for the first portion 20 to be inserted only in part into the housing 22, as shown in FIG. 12, and an annular groove 43 can be formed in front of the distal end of the second portion 25, where appropriate, the width of the groove 43 depending on the degree to which the fastener portion of the first portion 20 is driven into the second portion 25.

The flexibility of the first portion 20 can be due solely to the choice of material from which it is made, or it can be due both to the choice of material and to its shape.

A thin shape, as shown in FIGS. 9 and 10, can impart greater flexibility.

Figure 11:
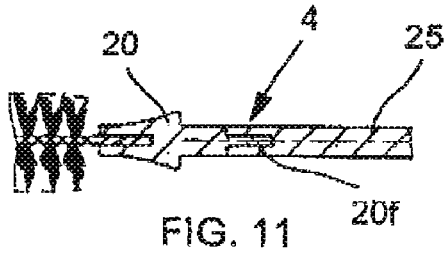

It is not beyond the ambit of the present invention for the first portion 20 to present a greatest transverse dimension that is greater than a greatest transverse dimension of the second portion 25, as shown in FIG. 11.

Figure 13:
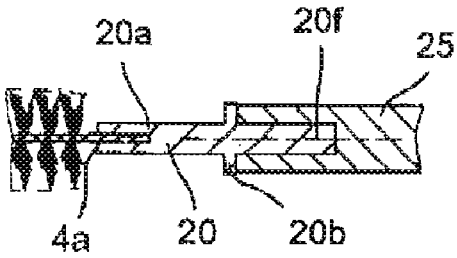

FIG. 13 shows a variant in which the first portion 20 includes a visible portion 20*a* that presents a transverse dimension that is smaller than the transverse dimension of the second portion 25.

Where appropriate, the first portion 20 can be made with a collar 20*b* that comes into abutment against the adjacent axial end of the second portion 25.

Figure 14:
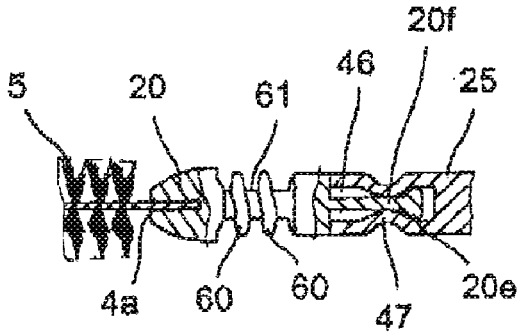

FIG. 14 shows the possibility of making the first portion 20 with a profile that varies between the part of the first portion 20 used for fastening the applicator member 5, and the part for fastening in the second portion 25.

In the embodiment shown, and by way of example, the first portion 20 includes a plurality of annular ribs 60 that are separated by annular grooves 61 that define zones of smallest diameter, thereby increasing the flexibility of the flexible portion 20 and acting on vibration. It can also be seen in this figure that the first portion 20 can include a wide head 20*e* that is retained in a housing of the second portion 25, e.g. by crimping said second portion in such a manner as to form an inwardly-directed indentation 47.

Figure 16:
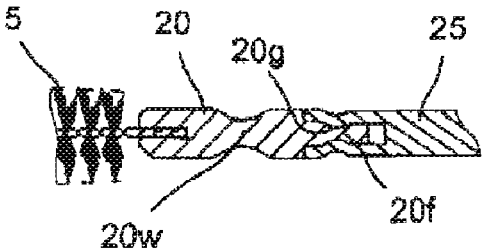

FIG. 16 shows the possibility of the first portion 20 presenting a part 20*f* for fastening on the second portion 25, a narrowing 20*g* possibly receiving an indentation resulting from crimping the second portion 25.

In general, as shown, the first portion can be made with a narrowing 20*w* that is situated axially between the part of the first portion used for fastening the applicator member on the first portion, and the part of the first portion 20 for fastening on the second portion 25.

Figure 17:
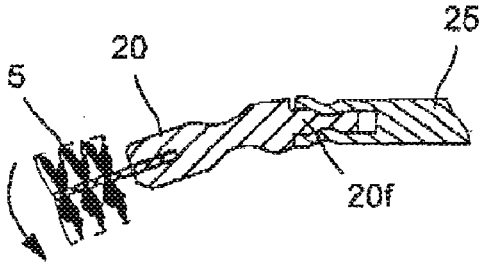

FIG. 17 shows the FIG. 16 stem while the flexible portion 20 is being flexed. It can be seen in this figure that not only can the first portion 20 deform at its annular narrowing, but also that the part for fastening on the second portion can stretch, a gap possibly appearing externally between the first and second portions.

Still in a variant, the first portion 20 can present a cross-section other than circular, of shape selected, for example, from the following list: polygonal, square, rectangular, triangular, non-circular, oblong, oval, elliptical, kidney-shaped, star-shaped, or with one or more grooves. In addition, the remainder of the stem can have a cross-section of shape selected from the same list. The cross-sections of the first portion and of the remainder of the stem can thus be identical or different, without going beyond the ambit of the present invention.

Figure 18:
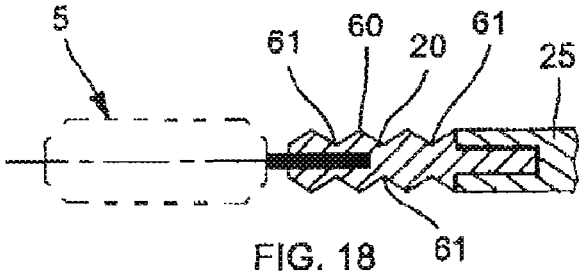
Figure 19:
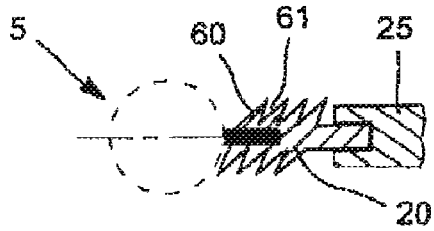

FIG. 18 shows another embodiment of the first portion 20 with a succession of recesses 61 that are constituted by annular grooves, for example.

Where appropriate, the ribs 60, defining between them the grooves 61, can be oriented obliquely relative to the longitudinal axis X of the applicator, as shown in FIG. 19. This can create asymmetry in treating vibration.

FIG. 19 also shows the possibility of the applicator or finishing member 5 being a brush or a comb presenting an envelope surface that is generally spherical.

Figure 20:
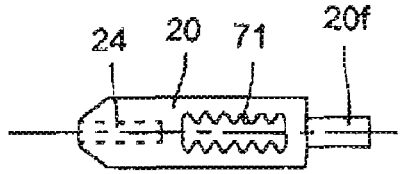

The first portion 20 can include a through opening 70, as shown in FIG. 20, of axis that is perpendicular to the longitudinal axis X of the applicator. By way of example, the through opening is a slot that can be elongate along the axis X, with edges 71 that are optionally regular.

Figure 21:
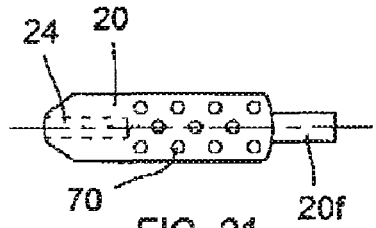

In the embodiment in FIG. 21, the first portion 20 includes a plurality of holes 70 constituting the same number of through openings.

Such through openings can modify vibration before it reaches the applicator or finishing member.

Figure 23:
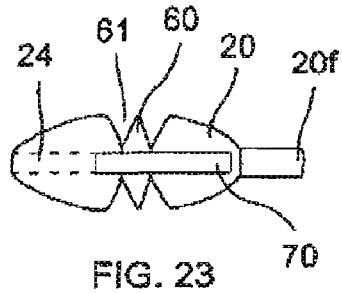

In the embodiment in FIG. 23, the housing 24 for fastening the applicator and/or finishing member 5 opens out into a through opening 70.

Figure 24:
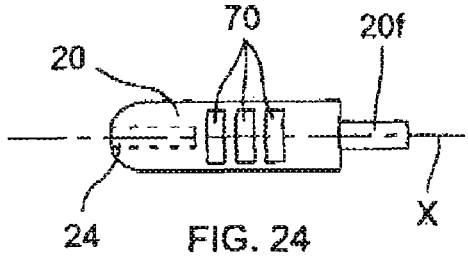

In the embodiment in FIG. 24, the first portion 20 includes a plurality of through openings 70, e.g. three through openings, that are in the form of parallel slots that are elongate along a long axis that is perpendicular to the longitudinal axis X, for example. The spacing between the slots, their orientation, and their dimensions could be selected as a function of the treatment desired for the vibration.

Figure 22:
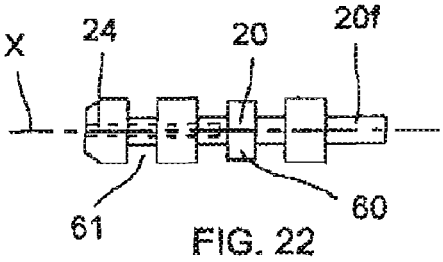

In the embodiment in FIG. 22, the first portion includes a plurality of square-sided annular grooves 61.

Figure 25:
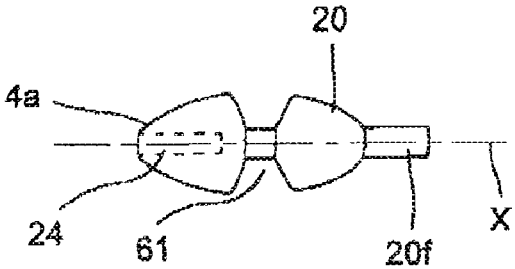

In the embodiment in FIG. 25, the first portion 20 includes an annular groove 61 that flares radially outwards, the parts that are situated on either side of the groove 21 having cross-sections that decrease towards the second portion 25 of the stem and towards the distal end 4*a* of the stem.

Figure 26:
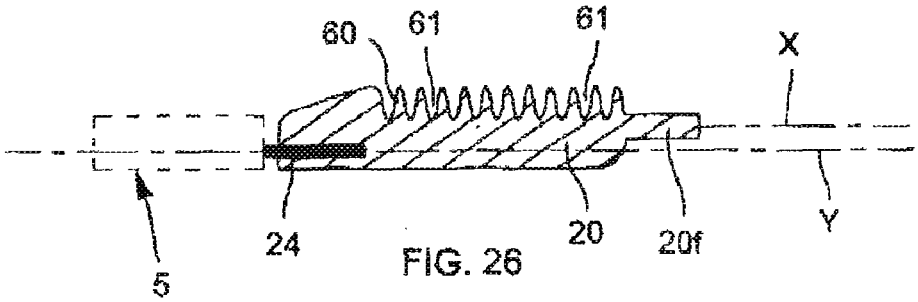

FIG. 26 shows the possibility of the first portion 20 including a series of recesses 61 on one side only of the first portion 20, the recesses 61 being in the form of teeth, for example. This can create asymmetry in treating vibration.

The housing 24 for fastening the applicator and/or finishing member 5 can be oriented along an axis Y, parallel to the axis X, the applicator member 5 being off-center relative to the longitudinal axis X.

Figure 27:
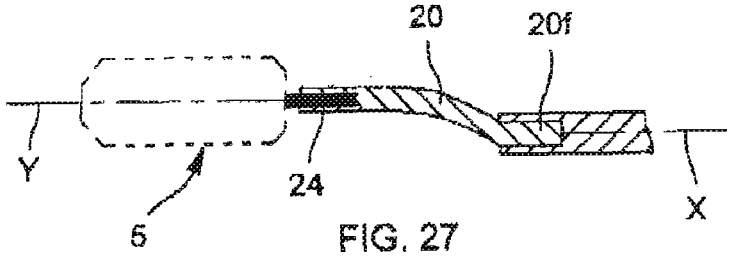

In the variant shown in FIG. 27, the first portion 20 extends along a longitudinal axis Y that is curvilinear, and the longitudinal axis of the applicator and/or finishing member 5 is offset relative to the longitudinal axis X.

Figure 28:
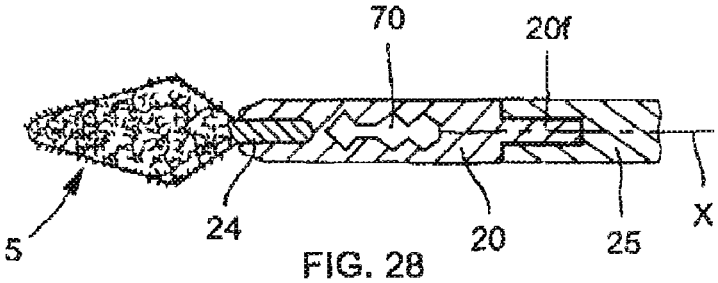

FIG. 28 shows the possibility of the applicator member 5 being in the form of a flocked endpiece, the invention not being limited to a particular applicator or finishing member.

The first portion 20 can include a through opening 70 having a profile that can vary along the axis X, the profile not necessarily being symmetrical about a plane that is perpendicular to the axis X, as shown.

Figure 29:
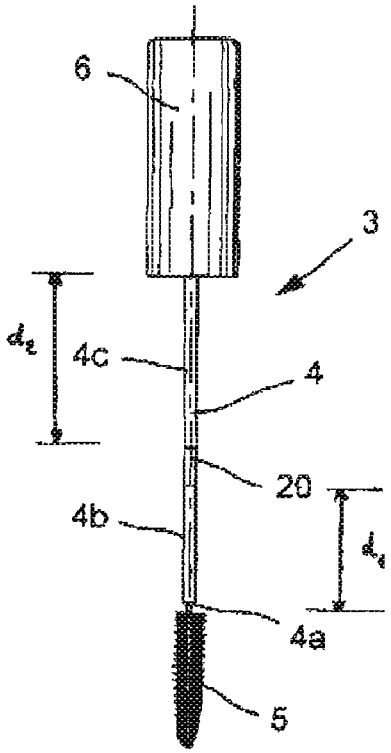
FIGS. 29 to 31 are elevation views showing variant applicators.

FIG. 29 shows that first portion 20 may be situated between portions of 4*b* and 4*c* of the proximal end of the first portion, these portions 4*b* and 4*c* being for example less flexible than the first portion 20 because made in a harder material.

Figure 30:
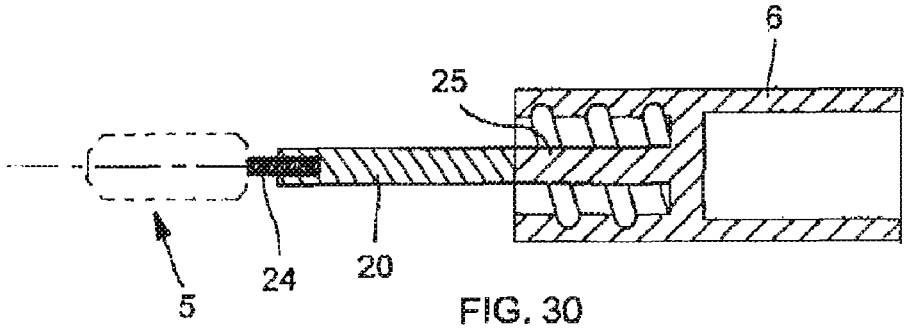

The distance d1 from the distal end of first portion 20 to the application member is lower than the distance d2 to the handle, and the first portion 20 is thus closer to the application member than to the vibration generator FIG. 30 shows the possibility of the first portion 20 constituting the major portion of the stem 4, e.g. extending as far as the distal end of the stem. In a variant not shown, the first portion does not extend as far as the distal end of the stem. In some embodiments, it can turn out to be preferable for the first portion to be situated closer to the applicator or finishing member than to the vibration generator, so as to avoid having vibration at amplitude that is too great at the applicator or finishing member.

Figure 31:
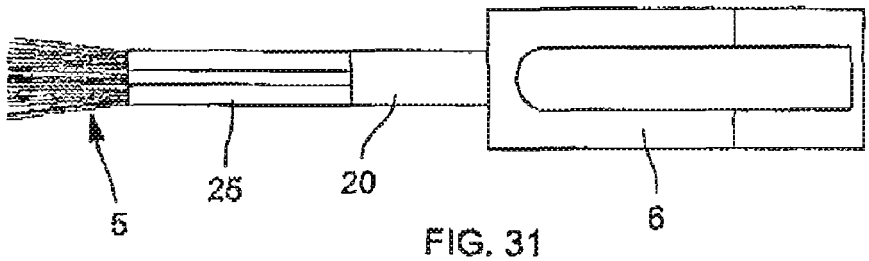

FIG. 31 shows the possibility of the applicator member 5 being in the form of a paint brush, the first portion 20 being interposed between the handle 6 and the second portion 25, said second portion being adjacent to the applicator member 5.

Figure 34:
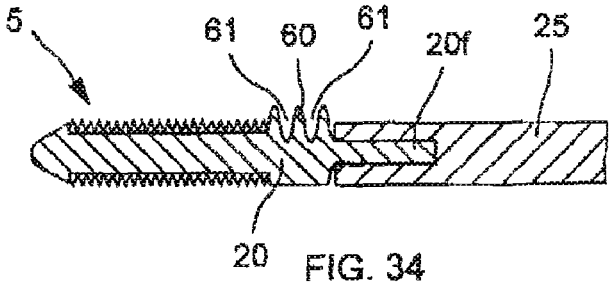
FIGS. 32 to 34 show variant embodiments of the applicator or finishing member.
Figure 32:
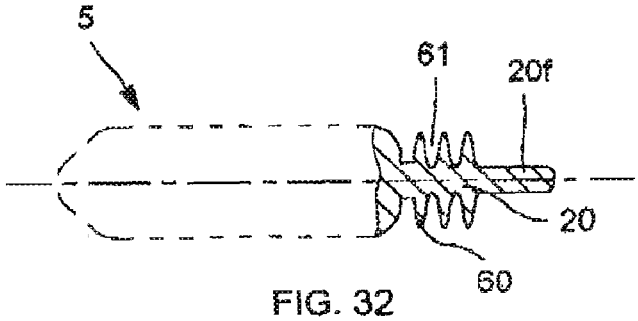
Figure 33:
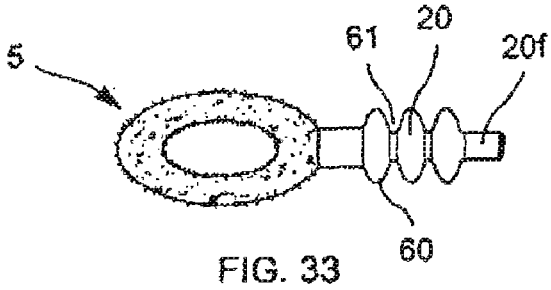

FIGS. 32 to 34 show the possibility of the first portion 20 being made integrally with the applicator and/or finishing member 5. The applicator and/or finishing member being an injection-molded brush or an injection-molded comb. The applicator and/or finishing member can also be an injection-molded endpiece, possibly flocked, as shown in FIG. 33.

In the embodiment in FIG. 32, a succession of recesses formed by annular grooves 61 is made in the first portion 20.

In the embodiment in FIG. 34, the recesses 61 extend on one side only of the applicator member 5.

Figure 35:
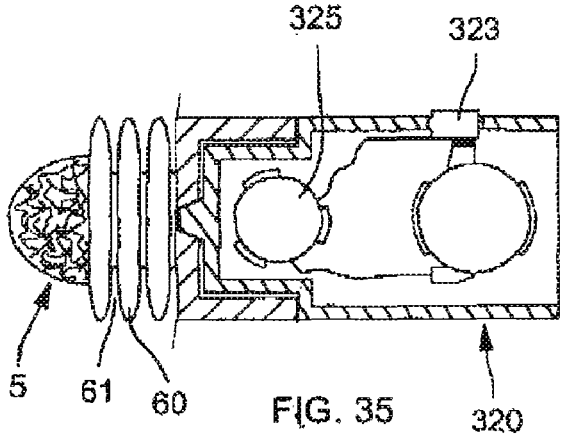
FIGS. 35 and 36 are views, partially in longitudinal section, showing other variant embodiments of the applicator.

The support of the applicator member 5 can be other than a stem configured to go through a wiper member and FIG. 35 shows an applicator device according to another aspect of the invention in which the support of the applicator member includes a succession of recesses 61, e.g. in the form of annular grooves, the applicator member 5 being a block of foam or a flocked membrane, for example, defining a dome-shaped applicator surface, for example.

It can be seen in this figure that the vibration source 320 can include a vibration generator 325 in the form for example of a disk-shaped motor.

Figure 36:
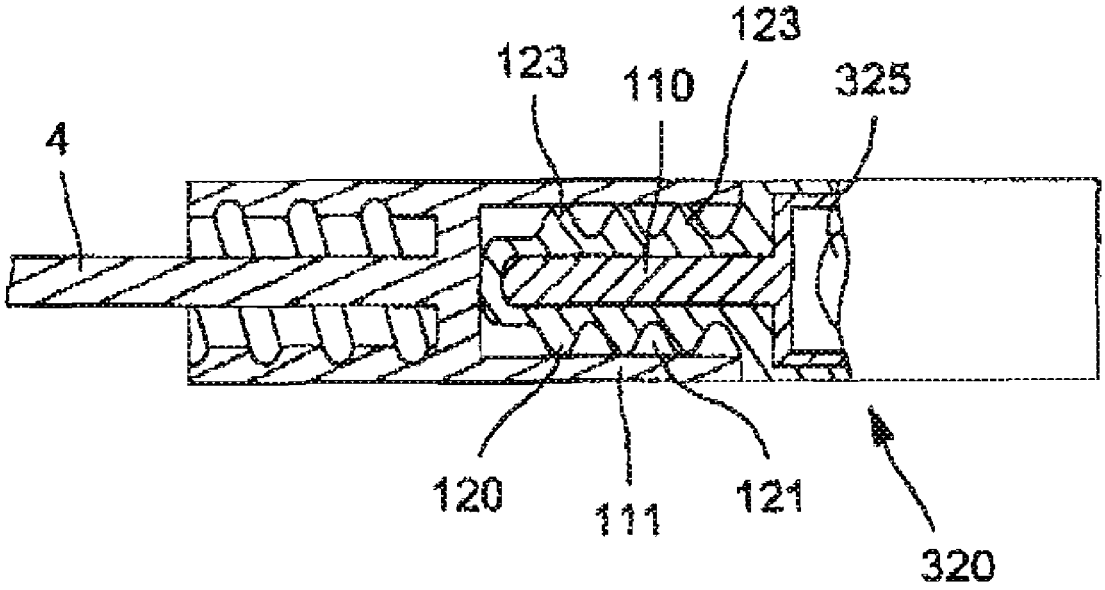

In the embodiment in FIG. 36, which also relates to another aspect of the invention, a first portion 120 of an elastically-deformable material, e.g. an elastomer, is interposed between a second portion 110 of the vibration source 320 and a third portion 111 of a housing of the applicator that receives the vibration source 320.

The first portion 120, that is overmolded onto the second portion 110, for example, includes recesses 121, e.g. in the form of annular grooves, formed between ribs that come to bear against the third portion 111.

In the embodiment in FIG. 36, the applicator may be any applicator, and comprises in end a application member such as brush or comb for example.

The invention in another of its aspects provides a vibrating source comprising a finger to transmit vibrations to an applicator, the vibrating source being configured to be inserted in a housing of the applicator, the finger being covered with a elastomeric material through vibrations pass.

Figure 37:
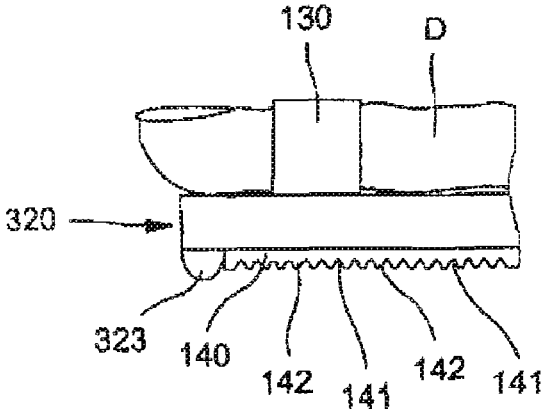
FIG. 37 shows a variant embodiment of the vibration source.

In the embodiment in FIG. 37, the vibration source 320 includes a ring 130 that is provided for mounting on the finger D of a user.

The vibration source 320 can includes a first portion 140 made of an elastomer material, with a series of recesses 141 and ribs 142, vibration being transmitted to the applicator (not shown) by means of the portion 140 while the vibration source 320 is in contact with a surface of the applicator.

The contactor 323 of the vibration source can be disposed on the same side as the portion 140, so that the vibration generator is triggered automatically when the vibration source is pressed against the applicator.

The invention in another of its aspects provides such a vibrating source.

In addition, in some of the above-described embodiments, the stem 4 is shown with a longitudinal axis X that is rectilinear, but it would not be beyond the ambit of the present invention if this were otherwise. The longitudinal axis X of the stem 4 can thus be curved. When a distance is measured along the stem the distance is measured parallel to the longitudinal axis of the stem.

Figure 15:
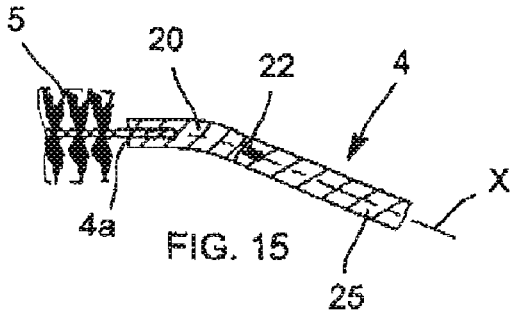

The curve of the longitudinal axis X of the stem 4 can be as a result of the curved shape of the first portion 20, as shown in FIG. 15. The curved shape can also be as a result of inserting a curved fastener portion of the first portion 20 more or less fully into the housing 22 of the second portion of the stem 4.

Figure 38:
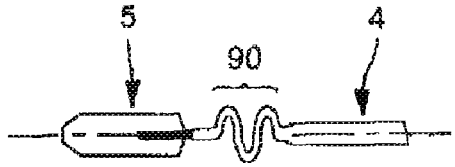
FIGS. 38 to 41 show variant embodiments of the applicator member support in accordance with the invention.

FIG. 38 shows a stem 4 for supporting an applicator member 5 and including an undulating portion 90 which may be flexible. By way of example, the undulating portion is made integrally with the remainder of the stem 4 by rolling, and can be formed at the end of the stem, the applicator member 5 being carried by the distal end of the undulating portion 90. By way of example, the undulations are transverse to the longitudinal axis of the stem.

By way of example, the section of the stem at the undulating portion is less than the section of the stem elsewhere. The spacing between the tops of the undulations, and the number of tops, is selected as a function of the frequencies to be attenuated and/or amplified.

Figure 39:
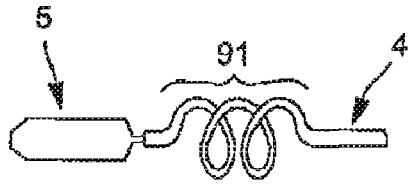
Figure 42:
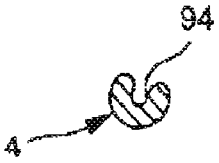
FIG. 42 is a section on XXXXII-XXXXII in FIG. 41.

FIG. 39 shows a stem 4 including a helical portion 91 which may be flexible. By way of example, the helical portion 91 is formed at the end of the stem, and can serve to fasten the applicator member.

The number of turns formed by the helical portion 91 can depend on the treatment desired for the vibration.

The helical portion 91 can be molded integrally with the remainder of the stem 4.

The undulating and helical portions 90 and 91 can also be made out of a material other than the material of the stem, e.g. out of a more flexible material.

The undulating and helical portions 90 and 91 can be situated other than at the end of the stem, e.g. in a location of the stem that is intermediate between its proximal and distal ends.

Figure 40:
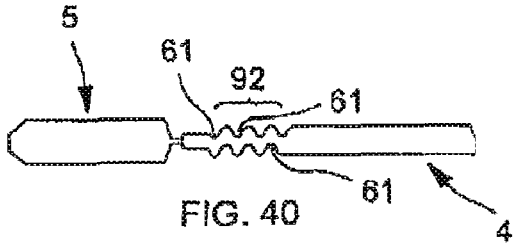

FIG. 40 shows a variant embodiment in which the stem presents a portion 92 that includes a series of recesses 61, e.g. annular recesses or recesses having some other shape. Theses recesses 61 may give the stem flexibility locally.

The portion 92 can be made of the same material as the remainder of the stem 4, and can be situated at the end of the stem or elsewhere.

Figure 41:
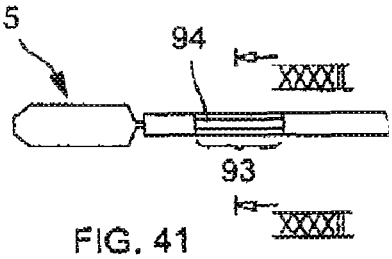

FIG. 41 shows a stem 4 having a portion 93 that presents a cross-section with a recess 94, i.e. that is not a solid circle. By way of example, the recess 94 is in the form of a longitudinal groove that extends over the entire length of the portion 93. The presence of the recess 94 modifies the transmission of vibration between the vibration generator and the applicator member 5, in particular it can create asymmetry in the propagation of vibration. The recess 94 may give the stem flexibility.

In a variant not shown, the recess 94 is replaced by a through slot of closed outline.

Figure 43:
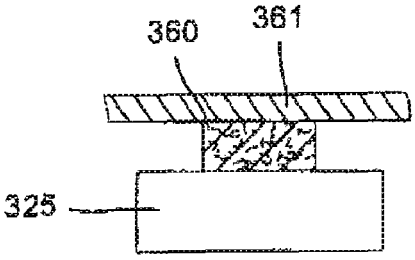
FIG. 43 shows a variant mounting for the vibration generator.

FIG. 43 shows the possibility of mounting the vibration generator 325 on a support 360 of an elastically-deformable material, e.g. an elastomer, the support 360 being connected to a wall 361 of the vibration source, or of the applicator when the vibration generator resides on the applicator, the vibration generator being contained in a housing that also serves as a handle for the applicator. The presence of the block 360 makes it possible for example to attenuate vibration harmonics, for example.

A further object of the invention, independently of the other objects of the invention, lies in the presence of an elastically deformable material in an applicator for applying a cosmetic composition, for mounting a vibration generator on the applicator.

Figure 44:
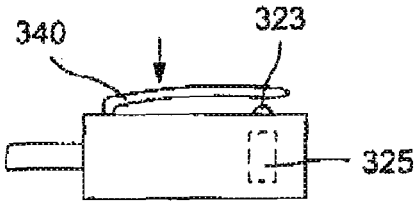
FIGS. 44 to 46 show examples of positioning the control surface relative to the vibration generator.

FIG. 44 shows the possibility of disposing the vibration generator 325 towards the proximal end of the applicator. The contactor 323 can be situated in the proximity of the generator 325, and it can, for example, be triggered by means of a lever defining a control surface 340 that is situated between the generator and the applicator member, relative to the longitudinal axis of the device.

This is a further object of the invention, independently of the manner the applicator is made, especially independently of the manner the applicator member is made and of the manner the stem carrying the applicator member is made.

Figure 45:
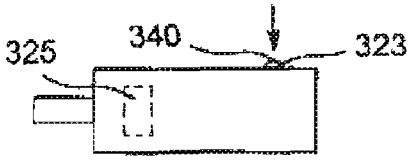

In the variant in FIG. 45, the vibration generator 325 is offset relative to the contactor 323 that defines the control surface 340, for example. By way of example, the contactor 323 is closer to the proximal end of the applicator than the vibration generator 325. By way of example, the spacing between the vibration generator 325 and the contactor 323 can be at least 20 mm so as to provide on the applicator, a grip surface that is not superposed with the vibration generator 325.

Figure 46:
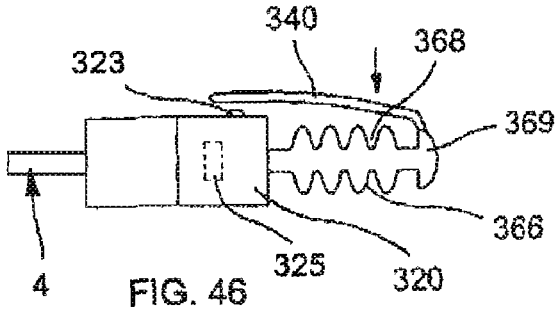

In the embodiment in FIG. 46, a grip surface 366 is defined at a certain distance from the vibration generator 325, by an end portion of the vibration source 320 including, for example, a series of recesses 368 that make it possible to attenuate the amplitude of vibration coming from the vibration generator 325. A lever can be provided on the vibration source for acting on the contactor 323, the lever being connected to the proximal end 369 of the vibration source, for example.

Figure 47:
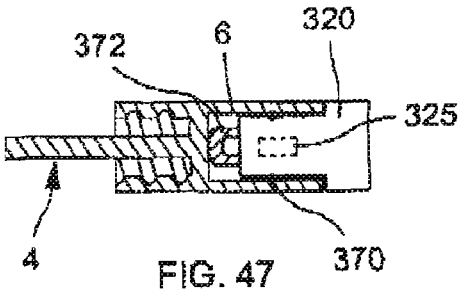
FIG. 47 is a fragmentary and diagrammatic longitudinal section of an applicator constituting a variant embodiment of the invention.

FIG. 47 shows the possibility of mounting the vibration source 320 on the handle 6 of the applicator by means of an O-ring 370 and of a first portion 372, said first portion being situated on the shortest path for vibration from the vibration generator 325 to the applicator or finishing member. The portion 372 can be made of an elastomer material and can come into contact with a second portion that is formed by the transverse wall defining the bottom of the housing receiving the vibration source 320. The first portion 372 exerts influence on vibration, e.g. it filters the vibration.

Regarding the aspects of the invention illustrated on FIGS. 45 to 47, those are independent, as for FIG. 44, from the stem 4, the applicator member and the shape of the handle.

The invention is not limited to the embodiments shown.

The characteristics of the various embodiments can be combined together within variants not shown. For example, the applicator members shown could be replaced by others. In variants, the applicator member could turn relative to the handle, in particular when the applicator member is a mascara brush.

The expression "comprising a" should be understood as being synonymous with "comprising at least one".

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An applicator for applying a cosmetic composition to human keratinous materials or for adding finishing touches to makeup, the applicator comprising:

a vibration source including a vibration generator that vibrates at a frequency lying in the range 1 Hz to 500 Hz;

a handle, a stem carried by the handle; and an applicator or finishing member carried by the stem for coming into contact with keratinous materials;

the stem further comprising a flexible first portion via which vibration travels along a shortest path between the vibration generator and the applicator or finishing member, the first portion being in contact with at least one second portion for vibration inlet or outlet;

the first portion being at a shorter distance from the applicator or finishing member than from the vibration generator; the first portion being interposed between second and third portions made out of materials that are harder than the first portion.

2. An applicator according to claim 1, the vibration source being above the stem.

3. An applicator according to claim 1, the second portion being fitted on the first portion.

4. An applicator according to claim 1, the second portion being molded in contact with the first portion.

5. An applicator according to claim 1, the handle constituting a closure cap for the receptacle containing the composition to apply.

6. An applicator according to claim 1, the material from which the first portion is made being selected from: polyolefins; PVCs; EVA; Pebax®; nitrile rubbers; butyl rubbers; silicone rubbers; latexes, thermoplastic alloys; polyamides; and acetal.

7. An applicator according to claim 1, the first portion including a housing for receiving a fastener endpiece for fastening the applicator or finishing member on the first portion.

8. An applicator according to claim 1, the first portion including at least one annular groove.

9. An applicator according to claim 1, the first portion including at least one recess opening out onto its lateral surface.

10. An applicator according to claim 1, the first portion including at least one through opening.

11. An applicator according to claim 10, the through opening being of axis that is perpendicular to the longitudinal axis of the stem.

12. An applicator according to claim 10, the through opening comprising at least one slot.

13. An applicator according to claim 1, the applicator or finishing member extending along a longitudinal axis that does not coincide with the longitudinal axis of a proximal portion of a support to which the applicator or finishing member is connected.

14. An applicator according to claim 1, the first portion extending along a longitudinal axis that coincides with the longitudinal axis of a proximal portion of a support to which the applicator or finishing member is connected.

15. An applicator according to claim 1, the first portion extending along a longitudinal axis that does not coincide with the longitudinal axis of an adjacent portion of the support.

16. An applicator according to claim 1, the first portion presenting a shape that is not axially symmetrical.

17. An applicator according to claim 1, the first portion being undulated or helicoïdal.

18. An applicator according to claim 1, the applicator or finishing member being a brush or a comb for applying a composition to the eyelashes and/or the eyebrows, or for adding finishing touches to makeup on the eyelashes and/or the eyebrows.

19. An applicator according to claim 1, the vibration source comprising a ring for mounting on a finger of a user.

20. An applicator according to claim 1, the vibration source being housed at least partially in the handle.

21. A method of applying a cosmetic composition to human keratinous materials or for adding finishing touches to makeup, the method comprising:

bringing a surface of an applicator or finishing member as defined in claim 1 that is being subjected to vibration coming from a vibration source into contact with keratinous materials.

* * * * *